US010697078B2

(12) United States Patent
Sato et al.

(10) Patent No.: US 10,697,078 B2
(45) Date of Patent: Jun. 30, 2020

(54) METHOD OF FORMING CU PLATING, METHOD OF MANUFACTURING CU-PLATED SUBSTRATE, AND CU-PLATED SUBSTRATE

(71) Applicant: Mitsubishi Electric Corporation, Chiyoda-ku (JP)

(72) Inventors: Yuji Sato, Chiyoda-ku (JP); Jun Fujita, Chiyoda-ku (JP); Motoru Yoshida, Chiyoda-ku (JP); Kazuyo Endo, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/772,147

(22) PCT Filed: Nov. 12, 2015

(86) PCT No.: PCT/JP2015/081883
§ 371 (c)(1),
(2) Date: Apr. 30, 2018

(87) PCT Pub. No.: WO2017/081797
PCT Pub. Date: May 18, 2017

(65) Prior Publication Data

US 2019/0062938 A1 Feb. 28, 2019

(51) Int. Cl.
*C25D 3/38* (2006.01)
*C25D 5/02* (2006.01)
*C25D 7/12* (2006.01)

(52) U.S. Cl.
CPC ..... *C25D 5/022* (2013.01); *C25D 3/38* (2013.01); *C25D 5/02* (2013.01); *C25D 7/12* (2013.01); *C25D 7/123* (2013.01)

(58) Field of Classification Search
None
See application file for complete search history.

(56) References Cited

U.S. PATENT DOCUMENTS 6,429,523 B1 * 8/2002 Andricacos ..... H01L 21/76843 257/751
2002/0043468 A1 * 4/2002 Mikkola ..... C25D 3/02 205/157

(Continued)

FOREIGN PATENT DOCUMENTS

CN 1319145 C 5/2007
JP 2003-249499 A 9/2003

(Continued)

OTHER PUBLICATIONS

International Search Report dated Jan. 26, 2016 in PCT/JP2015/081883 filed Nov. 12, 2015.

(Continued)

*Primary Examiner* — Stefanie S Wittenberg
(74) *Attorney, Agent, or Firm* — Oblon, McClelland, Maier & Neustadt, L.L.P.

(57) ABSTRACT

A method of forming Cu plating of the present invention includes: a first step of forming a Cu seed layer on one of surfaces of a substrate such that an average grain size is 50 nm or more and 300 nm or less; a second step of forming an oxide film on a surface of the Cu seed layer in an oxygen atmosphere; a third step of removing a part of the oxide film; and a fourth step of feeding power to the Cu seed layer to form Cu plating on a surface of the oxide film on the Cu seed layer by electrolytic plating.

5 Claims, 14 Drawing Sheets

(56) References Cited

U.S. PATENT DOCUMENTS

| | | | | |
|---|---|---|---|---|
| 2003/0034251 | A1* | 2/2003 | Chikarmane | C23C 18/1632 205/125 |
| 2004/0043609 | A1 | 3/2004 | Yamamoto | |
| 2004/0118697 | A1* | 6/2004 | Wen+ | C23C 14/58 205/215 |
| 2005/0164496 | A1* | 7/2005 | Guldi | H01L 21/76843 438/678 |
| 2007/0281457 | A1* | 12/2007 | Chu | H01L 21/2855 438/597 |

FOREIGN PATENT DOCUMENTS

| | | | |
|---|---|---|---|
| JP | 2005-340460 | A | 12/2005 |
| JP | 2006-45651 | A | 2/2006 |

OTHER PUBLICATIONS

Combined Chinese Office Action and Search Report dated Jun. 4, 2019, in Patent Application No. 201580084388.0, citing document AO therein, 13 pages (with unedited computer generated English translation).

The Second Office Action dated Oct. 9, 2019 in Chinese Patent Application No. 201580084388.0 with English translation.

* cited by examiner

METHOD OF FORMING CU PLATING, METHOD OF MANUFACTURING CU-PLATED SUBSTRATE, AND CU-PLATED SUBSTRATE

TECHNICAL FIELD

The present invention relates to a method of forming Cu plating, a method of manufacturing a Cu-plated substrate, and a Cu-plated substrate.

BACKGROUND ART

The process of forming Cu plating on a substrate by electrolytic plating broadly includes two steps. First, a metal thin film (seed layer) used for feeding power is formed in advance on a substrate (wafer) surface on which plating needs to be formed. Then, the substrate having the seed layer formed thereon is fixed to a jig for power feeding, and immersed in a plating solution. Then, power is fed to the seed layer, thereby forming plating (for example, PTD 1).

In PTD 1, oxygen plasma is applied to a resist opening in the seed layer formed on the substrate before plating (paragraphs [0008] to [0010]). This is for the purpose of forming a thin oxide film on the surface of the seed layer by applying oxygen plasma, to improve the wettability of the seed layer to the plating solution.

CITATION LIST

Patent Document

PTD 1: Japanese Patent Laying-Open No. 2006-45651

SUMMARY OF INVENTION

Technical Problem

The seed layer is often fabricated at an elevated temperature inside a film forming chamber in order to obtain a film having bulk-like characteristics. However, when Cu is raised in temperature, its grain size is increased, thereby increasing its internal stress. Consequently, the warpage of the substrate having the Cu seed layer formed thereon is increased. When the warpage is increased, the plating comes around to the back surface of the substrate during plating, which leads to a decreased plating yield. Furthermore, when the substrate is reduced in thickness, the stress is increased, so that the plating yield is further decreased.

In light of the above-described problems, the present invention aims to provide a method of forming Cu plating with improved yield.

Solution to Problem

A method of forming Cu plating of the present invention includes: a first step of forming a Cu seed layer on a surface of a substrate such that an average grain size is 50 nm or more and 300 nm or less; a second step of forming an oxide film on a surface of the Cu seed layer in an oxygen atmosphere; a third step of removing a part of the oxide film; and a fourth step of feeding power to the Cu seed layer to form Cu plating on a surface on a side of the oxide film of the Cu seed layer by electrolytic plating.

Advantageous Effects of Invention

According to the present invention, when the Cu seed layer is formed to have an average grain size of 50 nm or more and 300 nm or less, stress increase can be suppressed, and the warpage of the substrate can be reduced, thereby suppressing plating defects, with the result that the plating yield can be improved.

BRIEF DESCRIPTION OF DRAWINGS

FIGS. 3A and 3B are cross-sectional SIM images of a substrate with a plating film obtained after forming a plating film on a substrate with a Cu seed layer by a method of maintaining the grain size in a seed layer in the first embodiment, in which FIG. 3B is a partial enlarged view of FIG. 3A.

DESCRIPTION OF EMBODIMENTS

Figure 1A:
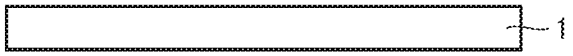
FIGS. 1A to 1F are schematic cross-sectional views for illustrating a method of forming Cu plating in the first embodiment.

Embodiments of the present invention will be hereinafter described with reference to the accompanying drawings, in which the same or corresponding components are designated by the same reference characters.

First Embodiment

FIGS. 1A to 1F are schematic cross-sectional views for illustrating a method of forming Cu plating in the first embodiment. FIG. 2 is a process flow diagram of the method of forming Cu plating in the first embodiment.

Figure 2:
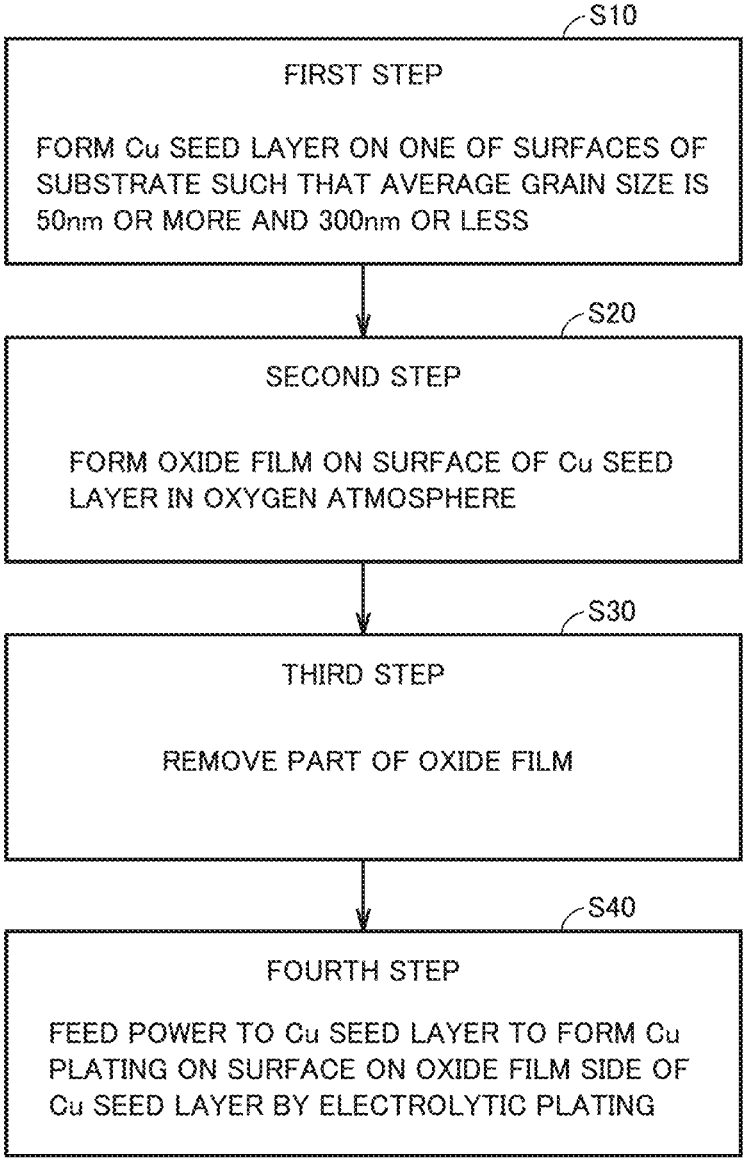
FIG. 2 is a process flow diagram of the method of forming Cu plating in the first embodiment.

First, a substrate 1 on which Cu electrolytic plating is to be formed is prepared (FIG. 1A).

Figure 1B:
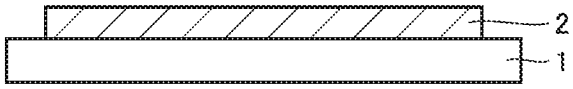

Then, a sputtering apparatus is used to form a Cu seed layer 2 (a power feeding Cu seed layer) on one of the surfaces of substrate 1 on which Cu plating is to be formed (FIG. 1B, the first step: S10 in FIG. 2). In this case, the Cu seed layer is formed such that the average grain size in the film is 50 nm or more and 300 nm or less. For example, by forming a Cu seed layer using a sputtering apparatus or the like at the setting of room temperature without using a temperature adjustment mechanism, grain growth is suppressed, so that the grain size can be reduced.

The room temperature of the film formation conditions used in the present embodiment means in a broad sense that the atmosphere temperature inside the chamber at the start of film formation is a room temperature (for example, 20° C. to 30° C.). Since the room temperature varies depending on the environment/the conditions of use, the temperature range is not limited to the above-described range. Even when the initial temperature inside the chamber is a room temperature, the temperature inside the chamber is raised with sputtering energy by forming a film. Thus, the actual film forming temperature may be equal to or higher than the room temperature (for example, 50° C. to 100° C.). Also, when film formation is continuously performed, the temperature inside the film forming chamber may remain at the same temperature as that during the previous film formation. Accordingly, even at the setting of the room temperature, this temperature inside the chamber may be still high at the start of film formation (for example, 30° C. to 80° C.). This situation also corresponds to film formation at the room temperature in the present embodiment as long as the initial temperature is set at the room temperature.

Figure 1C:
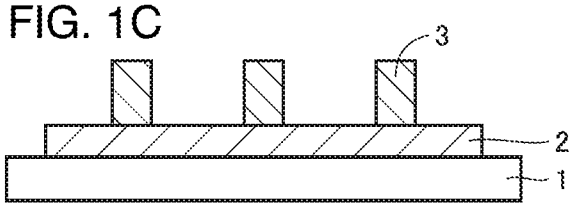

Then, a photoresist is used to form a resist 3 on the formed Cu seed layer 2 (FIG. 1C). After formation of resist 3, oxygen plasma is applied to the surface at the opening of resist 3 on Cu seed layer 2 formed on substrate 1, thereby forming an oxide film 4 (FIG. 1D, the second step: S20 in FIG. 2). In this oxygen plasma treatment, the conditions for the oxygen plasma treatment are controlled such that oxide film 4 is formed to have a thickness of 5 nm or more and 25 nm or less. In the present invention, oxide film 4 includes a layer obtained by alteration resulting from oxidization of the outermost surface of Cu that forms Cu seed layer 2.

Figure 1D:
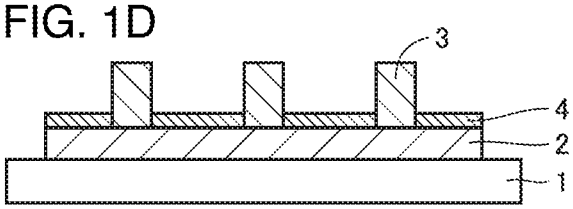
Figure 1E:
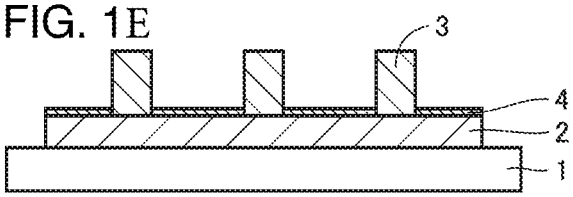

Then, by the etching treatment such as washing with dilute sulfuric acid, a part of oxide film 4 formed on the surface at the opening of Cu seed layer 2 is removed (FIG. 1E, the third step: S30 in FIG. 2). The third step is performed for the purpose of again controlling the film thickness or the surface of oxide film 4 formed in the second step to have a thickness suitable for forming a plating film, thereby implementing surface modification. For convenience of the manufacturing process, an oxide film needs to be formed on the surface of the Cu seed layer (the second step), but the oxide film is to be unnecessarily thickly formed in the oxygen plasma treatment in the second step. Thus, a redundant oxide film is removed by washing with dilute sulfuric acid in the third step.

However, the oxide film cannot always be reduced in thickness by washing with dilute sulfuric acid (the third step). When the original oxide film is too thick, the removing effect cannot be achieved. Accordingly, in the oxygen plasma treatment in the second step, the oxide film to be formed needs to be controlled to have a film thickness falling within the range in which the effect of washing with dilute sulfuric acid (the third step) can be achieved. Also, by this third step, the surface state of oxide film 4 can be rendered suitable for formation of a plating film in the fourth step.

Examples of the method of removing the oxide film formed by the oxygen plasma treatment may be dry etching, wet etching, and the like. The type of gas for dry etching, the type of etching solution used for wet etching, and the like are not particularly limited, and any removing method may be employed as long as formation of Cu plating is not adversely affected. However, it is preferable to perform wet etching using dilute sulfuric acid and the like in order to enhance the effect of improving the wettability of the Cu seed layer by the oxygen plasma treatment.

Figure 1F:
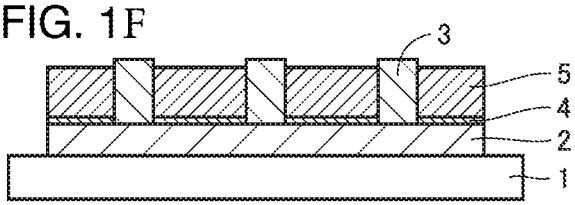

Then, substrate 1 including Cu seed layer 2 and oxide film 4 from which a part thereof has been removed is immersed in a plating solution, and power is fed to Cu seed layer 2, so that a Cu plating 5 can be formed on the surface on the oxide film 4 side of Cu seed layer 2 (FIG. 1F, the fourth step: S40 in FIG. 2).

As the step after formation of plating, substrate 1 having plating formed thereon may be washed by the washing treatment. Furthermore, an antioxidant may be applied in order to prevent oxidation of the surface of Cu plating 5.

In the present embodiment, a Cu-plated substrate can be manufactured as described above. The Cu-plated substrate includes at least a substrate and Cu plating formed on one of surfaces of the substrate.

Although the structure, the material, the shape and the like of substrate 1 (member to be plated) are not particularly limited, substrate 1 may be an insulator substrate, a semiconductor substrate (a semiconductor wafer), and the like, for example. Examples of the material of the semiconductor substrate may be Si, SiC, GaN, and the like.

Substrate 1 may be a semiconductor device or a semiconductor chip that are manufactured using a semiconductor substrate, for example. Examples of the type of the semiconductor device may be an insulated gate bipolar transistor (IGBT), a metal-oxide-semiconductor field-effect transistor (MOSFET), a diode, and the like. The substrate may be a member that is applicable to any intended uses other than a semiconductor device. Furthermore, the shape of the member to be plated (substrate) is not limited to a wafer, a chip and the like that are often used in a semiconductor device, but may be any size and shape as long as plating can be done.

Cu seed layer 2 is made of Cu. The thickness of Cu seed layer 2 is not particularly limited as long as electric charge can be supplied (power can be fed), and as long as Cu seed layer 2 can sufficiently function as a seed layer for electrolytic Cu plating. The thickness of Cu seed layer 2 is 300 nm, by way of example.

Furthermore, other than Cu seed layer 2, an adhesion layer may be formed between substrate 1 and Cu seed layer 2, for example, for the purpose of improving the adhesiveness between substrate 1 and Cu seed layer 2. In this case, the material of the adhesion layer can be selected in accordance with the purpose of forming an adhesion layer as long as no influence is exerted upon formation of Cu plating. Examples of the material of the adhesion layer may be Ti and the like.

Furthermore, the thickness of the adhesion layer is not particularly limited as long as this thickness falls within the range in which no influence is exerted upon formation of Cu plating. For example, when an adhesion layer is formed using Ti, the thickness of the adhesion layer is about 10 nm to 50 nm. Also, as to an adhesion layer formed between substrate 1 and Cu seed layer 2, two or more adhesion layers may be stacked as long as no influence is exerted upon formation of Cu plating.

In order to achieve the function as an adhesion layer, it is preferable to form an adhesion layer over the entire interface between substrate 1 and Cu seed layer 2. When the thickness of the adhesion layer is 10 nm or less, the adhesion layer cannot be formed over the entire interface, but a region partially lacking an adhesion layer may be formed. Accordingly, it is preferable that the thickness of the adhesion layer is more than 10 nm.

The upper limit value of the thickness of the adhesion layer may be set as appropriate. However, when the thickness of the adhesion layer is 100 nm or more, the function as an adhesion layer can be achieved, but an unnecessarily thickly formed film leads to an increase in resistance component, so that the device characteristics may be adversely affected. Thus, the thickness of the adhesion layer is preferably less than 100 nm, and more preferably 50 nm or less.

The resist material used for forming resist 3 may be any type of resist as long as no influence is exerted upon formation of Cu plating, and may be a positive-type or negative-type resist material. Also, when no resist needs to be formed, Cu seed layer 2 may be directly subjected to the oxygen plasma treatment in the next step without forming a resist.

When a photoresist (photosensitive resist material) is used as a resist material, for example, the following step is performed as a step of forming resist 3 on Cu seed layer 2. First, a photoresist is applied onto the surface of Cu seed layer 2 formed on substrate 1, and the applied photoresist is uniformly spread over the entire surface of Cu seed layer 2 by using a spin coater. Then, a photomask is placed on the photoresist uniformly spread over substrate 1, to which ultraviolet rays are applied using an exposure machine. Then, substrate 1 with a photoresist to which ultraviolet rays have been applied is immersed in a developing solution, to remove an unhardened resist. Thereby, resist 3 can be formed.

Figure 3A:
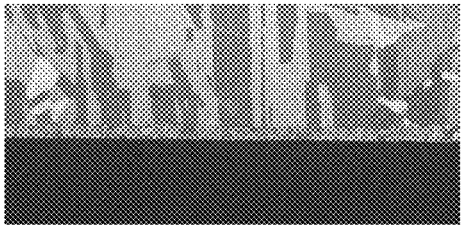
Figure 3B:
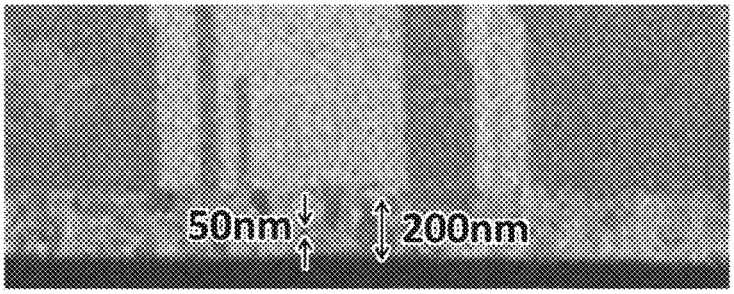

FIGS. 3A and 3B show cross-sectional SIM images of a Cu-plated substrate obtained after a plating film is formed on the substrate having Cu seed layer 2 formed thereon (the substrate with a Cu seed layer) at the room temperature by a method of maintaining the grain size in the seed layer. FIG. 3B is a partial enlarged view of FIG. 3A. As a result of measuring each grain size in Cu seed layer 2 based on FIG. 3B, about 80% of crystals had a grain size of 70 nm to 80 nm. Thus, it is considered that the average grain size in this Cu seed layer is about 75 nm that is generally a simple average of the upper limit value and the lower limit value of these grain sizes. The strict average grain size can be calculated by using an analysis method such as cross-sectional SIM observation, by which crystal grains can be observed, and measuring and averaging a plurality of grain sizes based on the analysis results.

In this way, by forming a Cu seed layer at the room temperature, the grain sizes in the Cu seed layer can be reduced as compared with the case where the Cu seed layer is formed at an elevated temperature. Also, as a method of reducing the average grain size in the Cu seed layer, a Cu seed layer may be formed at the room temperature without using a temperature raising mechanism. Thus, not by using a temperature raising mechanism, the time period for film formation (the time period required for forming a Cu seed layer) can be shortened and facility investment can be reduced, so that Cu plating can be inexpensively and highly efficiently formed.

Furthermore, it turned out that Cu seed layer 2 also includes crystals having sizes other than the above, for example, crystals having sizes of 50 nm, 150 nm, 300 nm and the like, and having a maximum size of 300 nm. It is presumed that the grain sizes are various because, unlike the normal growth mode, certain energy is applied to cause coalescence of crystal grains, thereby forming a relatively large grain size.

Such coalescence of crystal grains depends also on the thickness of the Cu seed layer to be formed. Thus, as the Cu seed layer becomes thicker, the maximum grain size becomes larger. However, in the case where the Cu seed layer is formed at the room temperature as in the present embodiment, the growth rate of each crystal grain abruptly becomes slow when the thickness is 300 nm or more. Accordingly, it is considered that the upper limit of the grain size is about 300 nm. Also, when a film is formed (when a Cu seed layer is formed), and even if such film formation is done at the room temperature, crystals grow to a certain extent by applying sputtering energy to the film. Thus, it is considered that the lower limit of the grain size is about 50 nm. In view of the above, it is preferable that each grain size in the Cu seed layer is 50 nm or more and 300 nm or less.

The stress of the film (Cu seed layer) increases in inverse proportion to the square of thickness change of the substrate. For example, when the substrate is formed to have a thickness corresponding to one third of the thickness of the conventional substrate, the film stress is increased nine times as compared with the conventional substrate. Accordingly, when forming a film on a substrate reduced in thickness, it is more important to take measures for reducing the film stress.

As a way to reduce the stress resulting from Cu seed layer 2, the average grain size in the Cu film may be reduced. When the average grain size is small, grain boundaries are increased in number. Thus, the generated stress is alleviated in these grain boundaries, so that the stress in the entire film is reduced. On the other hand, when the average grain size is increased, grain boundaries are decreased in number, thereby reducing the effect of alleviating the stress, so that the stress in the entire film is increased. As an example that the film stress is changed in accordance with the average grain size in the Cu film, there may be a situation where the film stress is changed depending on whether the Cu film has been subjected to heat treatment or not.

On the Cu sheet layer (Cu film), heat application gives energy to the particles, thereby causing surface migration, so that the grain sizes are increased. Accordingly, in the Cu seed layer that has been exposed to the high temperature state and increased in grain size, the stress of the film (Cu seed layer) is increased three times to ten times as compared with the Cu seed layer formed (without being subjected to annealing) at the room temperature. Thus, when the average grain size in the Cu seed layer is kept small at 300 nm or less, the film stress can be reduced to about one-third to one-tenth. In this way, it is effective to set the average grain size in the Cu seed layer to be 50 nm or more and 300 nm or less as countermeasures against the stress increase in the Cu seed layer resulting from the substrate reduced in thickness.

Cu seed layer 2 in the present embodiment is smaller in average grain size and smaller in area density (film density) than Cu plating produced by electrolytic plating.

The average grain size in Cu seed layer 2 formed as Cu seed layer 2 is 50 nm or more and 300 nm or less, as described above. In this way, as a method of forming Cu seed layer 2 so as to have an average grain size of 50 nm or more and 300 nm or less, there is a method of forming Cu seed layer 2 at the room temperature as the temperature inside the film forming chamber, which is set without using a temperature raising mechanism of the sputtering apparatus. When the temperature is elevated during formation of Cu seed layer 2, the same effect as that achieved by annealing describe above is caused, so that the average grain size is increased, thereby increasing the stress.

In view of the above, as a method of obtaining a Cu seed layer reduced in average grain size, it is effective to form a Cu seed layer at the room temperature without using a temperature raising mechanism. Then, by forming a Cu seed layer having such grain sizes, the film stress is reduced, so that the Cu plating yield can be improved. Thus, it becomes possible to improve the reliability of the Cu-plated substrate such as a semiconductor device having Cu plating, which is formed by the method of forming Cu plating in the present embodiment.

In the oxygen plasma treatment performed for the purpose of improving the wettability for the seed layer (see PTD 1), if the energy of the oxygen plasma to be applied is not appropriately controlled, an oxide film is excessively formed on the Cu seed layer. The excessively formed oxide film remains as a residue (void) at the interface even after formation of plating, thereby inhibiting the continuity between the Cu seed layer and the Cu plating. This causes a problem that the electric characteristics and the reliability are adversely affected, so that the plating yield is decreased. On the other hand, by forming the oxide film to have a thickness of 5 nm or more and 25 nm or less, the amount of the oxide film remaining after formation of plating is reduced, and crystals are coalesced into one at the interface between the Cu seed layer and the Cu plating, thereby forming an excellent interface. Thus, the plating yield can be improved, and the characteristics of the device (the Cu-plated substrate) can be improved.

Figure 4:
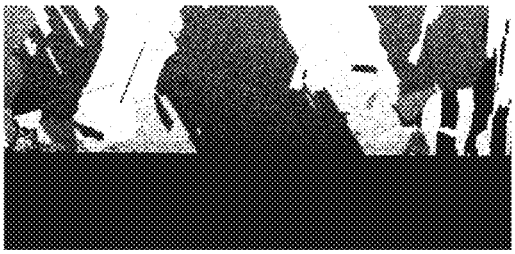
FIG. 4 is a cross-sectional SIM image of a Cu-plated substrate in the first embodiment.

FIG. 4 shows a cross-sectional SIM image of a Cu-plated substrate after Cu plating is formed on the Cu seed layer. As shown in FIG. 4, it turns out that, by forming a Cu seed layer and Cu plating using the method in the present embodiment, crystals are coalesced into one at the interface between the Cu seed layer and the Cu plating, so that an excellent interface can be formed. This results from the effect achieved by performing the second step such that the oxide film formed by the oxygen plasma treatment performed for the Cu seed layer has a thickness of 5 nm or more and 25 nm or less.

Furthermore, when the area density of the Cu plating is defined as 100%, the area density of the Cu seed layer is preferably 60% or less. When the Cu seed layer is reduced in area density in this way, the average grain size in the Cu seed layer can be controlled to fall within the range in the present embodiment. For example, by forming a seed layer using a sputtering apparatus or the like at the room temperature, the Cu seed layer can be reduced in area density.

Figure 5:
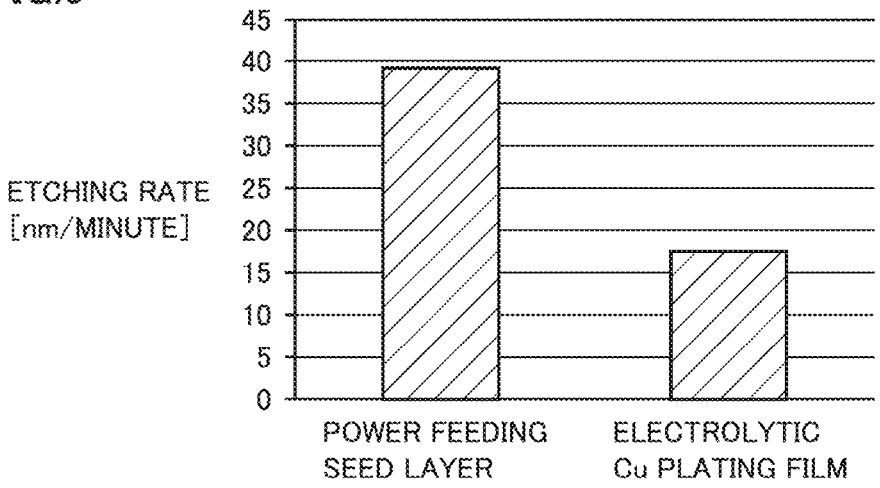
FIG. 5 is a diagram of etching rate comparison between the Cu seed layer and the Cu plating in the first embodiment.

FIG. 5 is a diagram of etching rate comparison between the Cu seed layer and the Cu plating. FIG. 5 shows a graph of the etching rate obtained when Ar plasma is applied to each of the Cu seed layer (power feeding seed layer) and the Cu plating (electrolytic Cu plating film). The Cu seed layer and the Cu plating that have been compared with each other respectively correspond to: a Cu seed layer (having an average grain size of approximately 75 nm) formed at the room temperature (without using a temperature raising mechanism) and having an excellent interface as shown in FIG. 4 in the present embodiment; and Cu plating formed by electrolytic plating.

As shown in FIG. 5, the Cu plating and the Cu seed layer are different in etching rate, in which the etching rate of the Cu seed layer is about 2 times higher than the etching rate of the Cu plating. Generally, when the area density of the film is relatively low and there are many crystal defects, coupling of atoms becomes unstable and therefore is disconnected even with weaker energy, and then, etching is executed. Thus, the etching rate during etching with Ar plasma or the like is higher in the film having a lower area density than in the film having a higher area density. Accordingly, the area density ratio can be converted from the etching rate ratio. In other words, the area density ratio in the present embodiment corresponds to the reciprocal of the etching rate ratio.

As shown in FIG. 5, the etching rate of the Cu seed layer (power feeding seed layer) formed so as to have an average grain size of 75 nm was about two times higher than the etching rate of the Cu plating (electrolytic Cu plating film) formed by electrolytic plating. Thus, it is considered that the area density of the Cu seed layer is about half the area density of the Cu plating.

Since the area density of the Cu film (Cu seed layer) may vary also depending on the film formation conditions, an error of about 10% (±5%) needs to be taken into consideration. Specifically, an error of 10% (±5%) of the etching rate and an error of 10% (±5%) of the film quality need to be taken into consideration. It is considered that, even in consideration of such errors, when the area density of the Cu plating formed by electrolytic plating is defined as 100% based on the above-mentioned etching rate ratio, the area density of the Cu seed layer formed at the room temperature is 60% or less.

The area densities of the Cu seed layer and the Cu plating may be calculated, for example, using Rutherford backscattering spectrometry (RBS), X-Ray Reflectivity (XRR), and the like.

Figure 6:
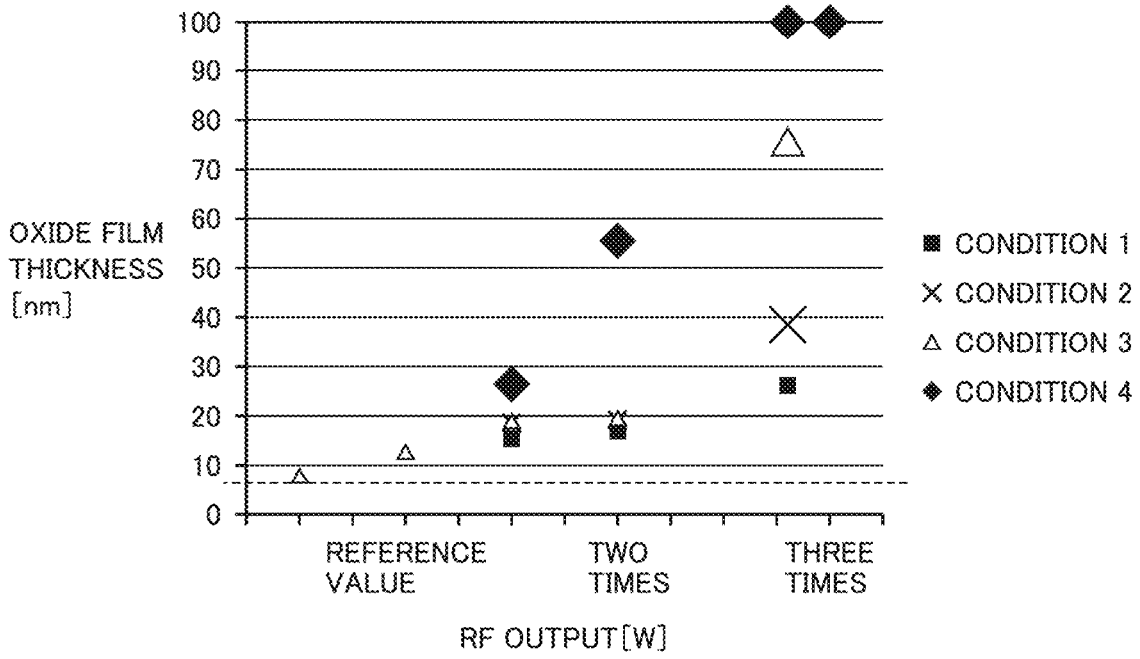
FIG. 6 is a graph showing the relation between the thickness of an oxide film and oxygen plasma treatment conditions.

FIG. 6 is a graph showing the relation between the thickness of the oxide film formed on the Cu seed layer by the oxygen plasma treatment and the oxygen plasma treatment conditions. The oxygen plasma treatment was performed by using a reactive ion etching (RIE) apparatus as a plasma treatment apparatus to change the value (on the horizontal axis in FIG. 6) of the high frequency output (RF output) and the oxygen flow rate (conditions 1 to 4). As a result of measuring the thickness of the natural oxidation film formed on the surface of the seed layer (not subjected to the plasma treatment) immediately after forming a Cu seed layer and a resist on the substrate, the thickness of the natural oxidation film was about 7 nm. This film thickness is shown by a dotted line in FIG. 6.

In order to achieve the wettability improving effect that is an object of the oxygen plasma treatment performed for the Cu seed layer, it is desirable that an oxide film is uniformly formed on the entire Cu seed layer. For example, there are valleys formed between the crystal grains on the film surface, into which plasma is less likely to flow, so that an oxide film is less likely to be formed thereon. In order to form an oxide film also on such a portion into which plasma is less likely flow, it is preferable that the thickness of the oxide film is 5 nm or more on the entire surface of the Cu seed layer.

The Cu seed layer having a large average grain size and a high density is less likely to be oxidized. Thus, even when such a Cu seed layer undergoes the normal plasma treatment, only an oxide film having a thickness of about 2 nm to 3 nm can be formed.

Furthermore, when the treatment time period of the oxygen plasma treatment is lengthened in order to increase the thickness of the oxide film, the temperature inside the plasma treatment chamber rises due to plasma energy, to thereby raise the temperature of the Cu seed layer, so that stress may be increased. Accordingly, it is desirable that the plasma treatment time period is relatively short.

In the Cu film (Cu seed layer) in the present embodiment formed at the room temperature in order to form a Cu seed layer to have an average grain size of 50 nm or more and 300 nm or less, the film density (area density) is relatively low, so that oxidation is more likely to progress as compared with the case of normal Cu. Thus, even in a short time period during which the temperature inside the chamber does not rise, an oxide film having a thickness of 5 nm or more (for example, about 10 nm), which is thicker than the conventional oxide film, can be formed on the Cu seed layer as described above. Even in consideration of about 1 nm or about 2 nm as a measurement error of the thickness of the oxide film, when the thickness of the natural oxidation film is 7 nm as shown in FIG. 6, it is conceivable that the minimum thickness of the oxide film shown in FIG. 6 is about 5 nm.

Figure 7:
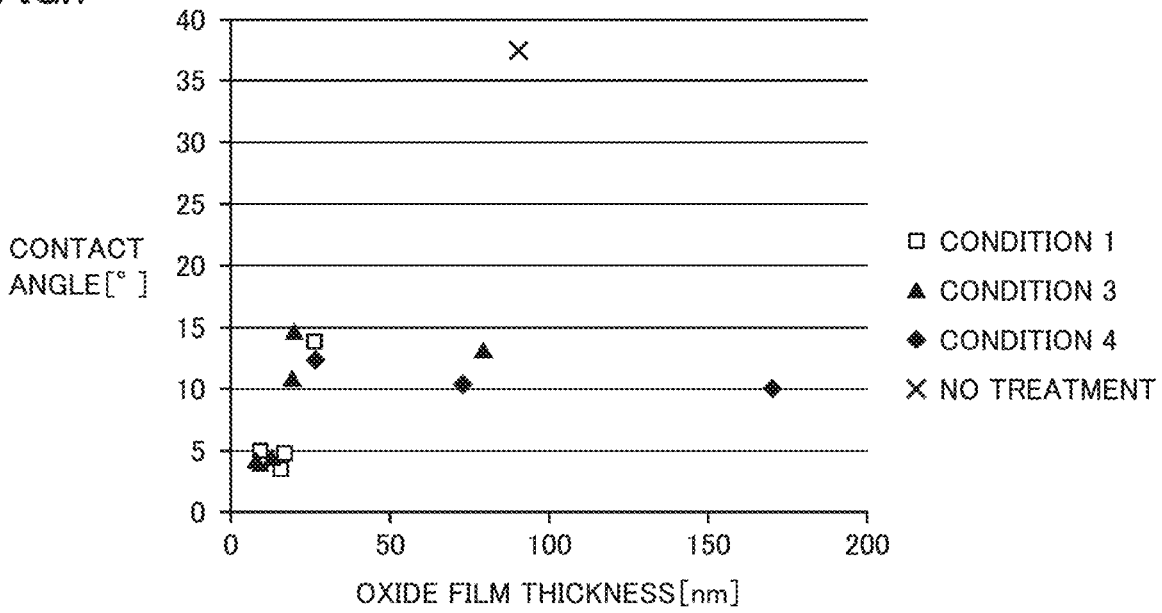
FIG. 7 is a graph showing the relation between a contact angle on the surface of the oxide film formed on the surface of the Cu seed layer and the thickness of the oxide film.

FIG. 7 is a graph showing the result of measuring the contact angle of the Cu seed layer having undergone the oxygen plasma treatment. Conditions 1, 3, and 4 are the same as those in the above description and FIG. 6. It turns out from FIG. 7 that each oxide film having a thickness of 5 nm or more exhibits excellent wettability. Accordingly, as described above, it is preferable that the lower limit of the thickness of the oxide film formed on the Cu seed layer having undergone the oxygen plasma treatment is 5 nm that is a sufficient thickness for film formation and that is approximately the same as the thickness of the natural oxidation film.

In FIG. 6, in the case where an excessive oxide film is formed on Cu seed layer 2 and the color of the surface of Cu seed layer 2 is changed, the results are plotted by marks larger than others. When an excessive oxide film is formed in this way, though depending on the washing conditions in the subsequent step, an excellent interface as shown in FIG. 4 cannot be formed, and reliability improvement by stress reduction cannot be achieved.

As shown in FIG. 6, it turns out that, also when the RF output and the oxygen flow rate in the oxygen plasma treatment are changed, the thickness of the oxide film can be controlled to be 5 nm or more and 25 nm or less on a plurality of oxygen plasma treatment conditions. In each oxide film formed on Cu seed layer 2 and having a thickness in the range of 5 nm or more and 25 nm or less, discoloration of the surface resulting from excessive oxidation of the seed layer did not occur. However, in each oxide film formed on Cu seed layer 2 and having a thickness in the range of 25 nm or more, the surface of Cu seed layer 2 was excessively oxidized and thereby discolored.

Then, the evaluation test was conducted for checking the change in the effect of washing with dilute sulfuric acid, which is caused in accordance with the thickness of each oxide film formed on the Cu seed layer. Table 1 shows the result of verifying the effect of removing the oxide film using dilute sulfuric acid as a remover in the third step (S30 in FIG. 2) (see FIG. 1E). The Cu seed layers respectively having oxide films with different thicknesses were prepared by the oxygen plasma treatment and washed with dilute sulfuric acid.

TABLE 1

| | Thickness of Oxide Film Having Undergone Oxygen Plasma Treatment [nm] | | | | |
|---|---|---|---|---|---|
| | 5 | 15 | 25 | 50 | 100 |
| Result of Removing Oxide Film by Washing with Dilute Sulfuric Acid | No Change | No Change | No Change | Discoloration Remains | Discoloration Remains |
| Effect of Reliability Improvement | Yes | Yes | Yes | No | No |

According to the result shown in Table 1, each oxide film having a thickness up to 25 nm could be removed, but each oxide film having a thickness exceeding 25 nm (for example, 50 nm) excessively formed on the surface of the Cu seed layer could not be removed, and the color of copper oxide remained on the surface of each film. When plating is performed in the state where the oxide film remains, such the oxide film remains as a void at the interface, which exerts an influence upon the reliability. Accordingly, it is preferable that the thickness of the oxide film is 25 nm or less.

Also as shown in FIG. 7, the oxide film having a thickness in the range of 5 nm or more and 25 nm or less exhibits sufficient wettability at a contact angle of about 15 degrees at the maximum. Based on this, it turns out that the oxide film formed by the oxygen plasma treatment in the present embodiment exhibits sufficient wettability and thus can contribute to reliability improvement. Accordingly, it is preferable that the upper limit of the thickness of the oxide film formed on the Cu seed layer in the present embodiment is set at 25 nm, which is an upper limit of the thickness of the oxide film that can be removed by washing with dilute sulfuric acid.

Figure 8A:
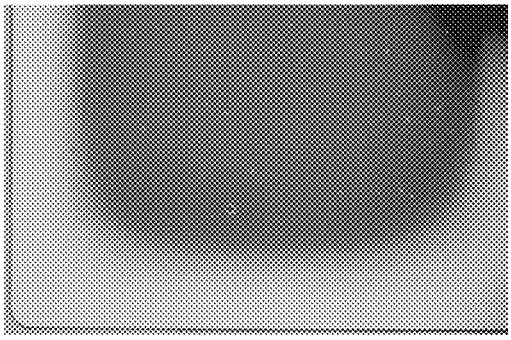
FIG. 8A shows a photograph of the surface of the Cu seed layer in the case where the thickness of the oxide film falls beyond the range of 5 nm or more and 25 nm or less.
Figure 8B:
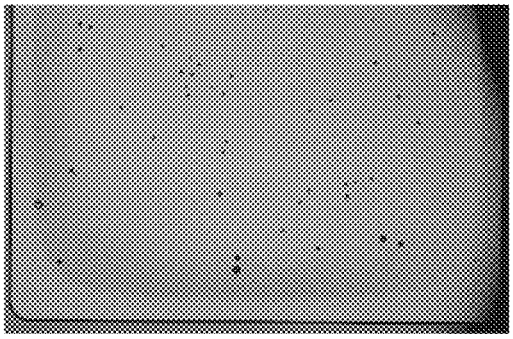
FIG. 8B shows a photograph of the surface of Cu plating.

FIG. 8A shows a photograph of the surface of the Cu seed layer having undergone the oxygen plasma treatment in the case where the Cu seed layer was subjected to the oxygen plasma treatment so as to form an oxide film to have a thickness falling beyond the range of 5 nm or more and 25 nm or less. The actual photograph shows that red discoloration occurs in copper oxide thickly formed by excessive oxidization of the surface (at the resist opening) of the Cu seed layer. The substrate with a Cu seed layer shown in FIG. 8A was washed with dilute sulfuric acid and then subjected to electrolytic Cu plating, thereby fabricating a Cu-plated substrate. FIG. 8B shows a photograph of the surface of the Cu plating of the substrate with a Cu seed layer. The actual photograph shows that color unevenness occurs on the surface of the Cu plating.

Figure 9A:
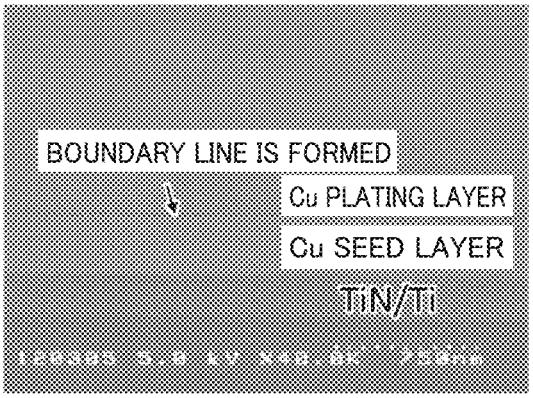
FIG. 9A is a cross-sectional SEM image of the substrate with a plating film shown in FIG. 8B.
Figure 9B:
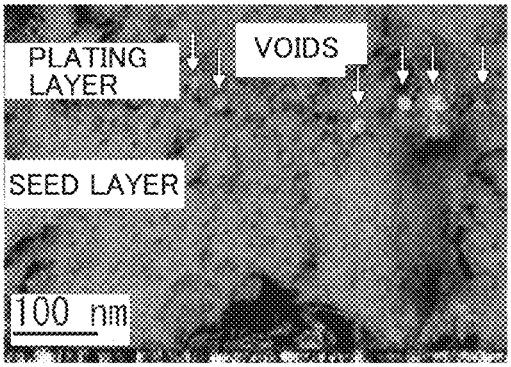
FIG. 9B is a partial enlarged view of FIG. 9A.

FIG. 9A is a cross-sectional SEM image of the substrate with a Cu plating film shown in FIG. 8B. FIG. 9A shows that a boundary line is formed at the interface between the Cu seed layer and the Cu plating. Also, voids are observed in the boundary portion in FIG. 9B that is a partially enlarged view of FIG. 9A. In other words, the crystal continuity between the Cu seed layer and the Cu plating is inhibited.

Figure 10A:
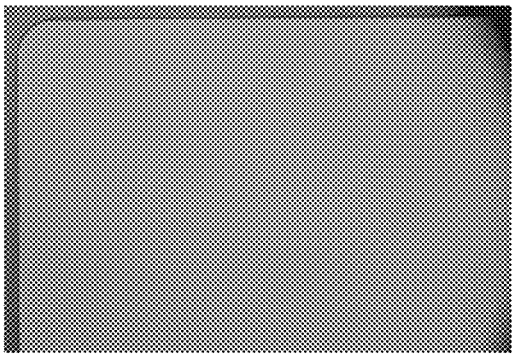
FIG. 10A shows a photograph of the surface of the Cu seed layer after an oxygen plasma treatment in the first embodiment.
Figure 10B:
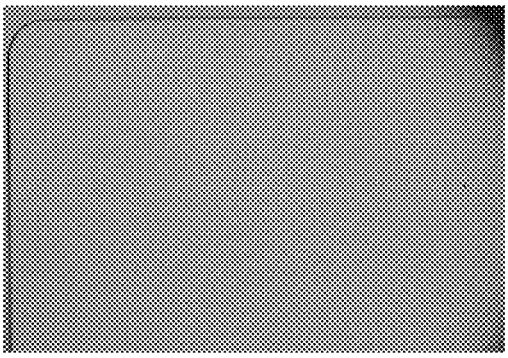
FIG. 10B shows a photograph of the surface of Cu plating.

On the other hand, FIG. 10A shows a photograph of the surface of the Cu seed layer having undergone the oxygen plasma treatment, which is obtained when the Cu seed layer is subjected to the oxygen plasma treatment in the state where the settings of the oxygen plasma treatment conditions are changed such that oxygen plasma with weaker energy is applied to the surface of the seed layer. Discoloration does not occur, and formation of an excessive oxide film is suppressed. Also, FIG. 10B shows a photograph of the surface of Cu plating formed after the Cu seed layer having undergone the oxygen plasma treatment in FIG. 10A is washed with dilute sulfuric acid. Color unevenness does not occur in plating.

Figure 11A:
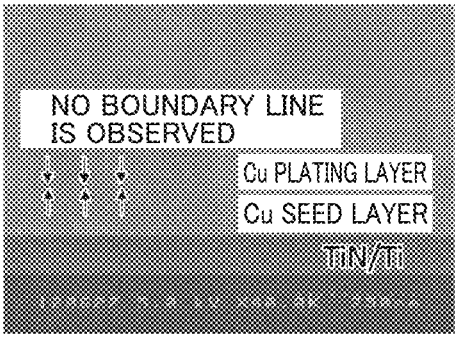
FIG. 11A is a cross-sectional SEM image of the Cu seed layer shown in FIG. 10B.
Figure 11B:
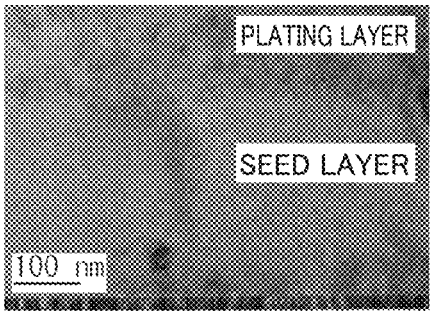
FIG. 11B is a partial enlarged view of FIG. 11A.

Furthermore, FIG. 11A shows a cross-sectional SEM image of the Cu seed layer shown in FIG. 10B. FIG. 11A shows that no boundary line is formed at the interface between the Cu seed layer and the Cu plating. Also, no void is found in the boundary portion between the Cu seed layer and the Cu plating in FIG. 11B that is a partial enlarged view of FIG. 11A. In other words, the crystal continuity between the Cu seed layer and the Cu plating is maintained.

In this way, by controlling the thickness of the oxide film to fall within the range of 5 nm or more and 25 nm or less, occurrence of voids between the Cu seed layer and the Cu plating could be suppressed. In view of the above, it turns out that the oxide film having a thickness of 5 nm or more and 25 nm or less allows: formation of an excellent interface as shown in FIG. 4; alleviation of the stress; and improvement in reliability of the semiconductor device.

Furthermore, oxygen plasma is applied to the seed layer, thereby exerting an influence upon the seed layer as follows: specifically, the film surface roughness may be increased by the energy of the applied oxygen plasma. When the surface roughness is increased, defects may occur during the subsequent device fabrication. Thus, it is desirable to confirm that the surface roughness is not increased.

Figure 12:
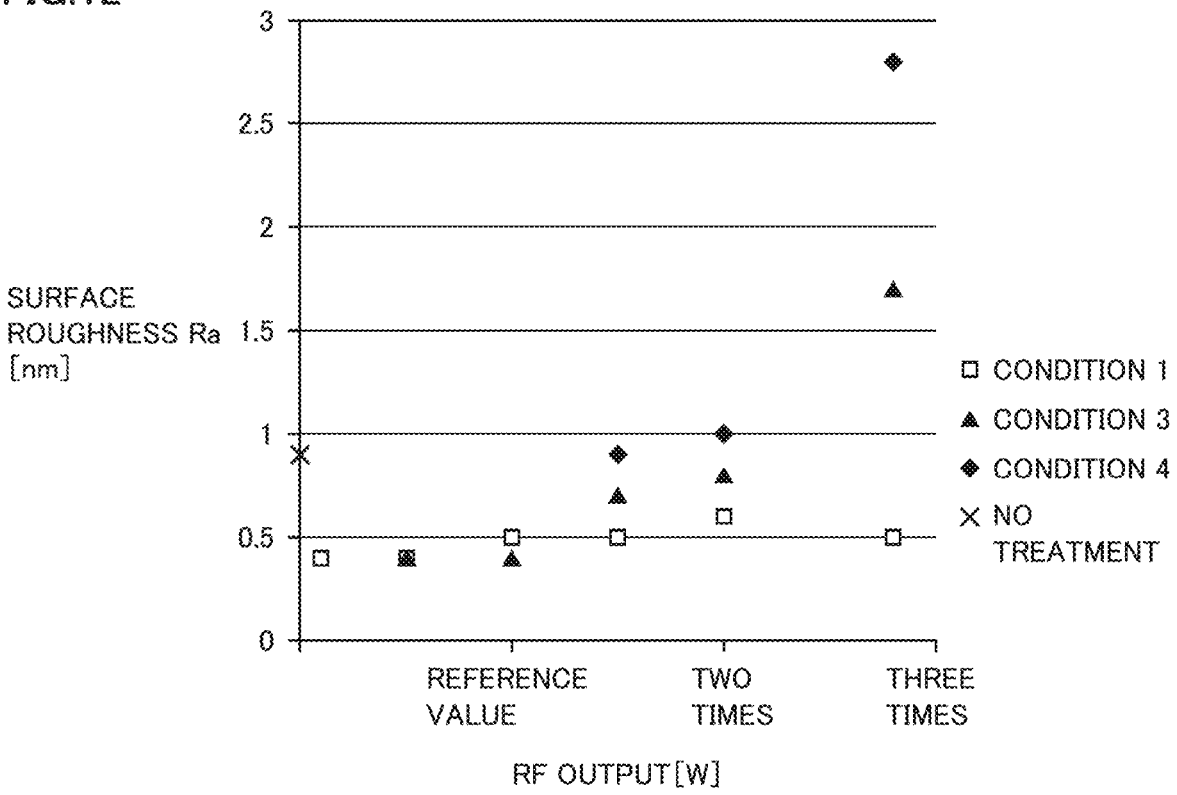
FIG. 12 is a graph showing the relation between the surface roughness of the oxide film formed on the surface of the Cu seed layer and the oxygen plasma treatment conditions.

FIG. 12 is a graph showing the results of measuring the surface roughness (an arithmetic mean roughness Ra) in order to show as to how the surface roughness of the Cu seed layer having undergone the oxygen plasma treatment changes in accordance with the applied oxygen plasma treatment conditions. Conditions 1, 3, and 4 are the same as those in FIG. 7. Even when any plasma treatment conditions were used, the surface roughness was 3 nm or less. In order to prevent defects from occurring during device fabrication, it is preferable that the range of the surface roughness is in a micrometer order. Thus, it can be determined that the surface roughness causes no adverse effect in the present embodiment.

The apparatus used in the oxygen plasma treatment for Cu seed layer 2 shown in FIG. 1D can be a high frequency inductively coupled plasma (ICP), an electron cyclone resonance (ECR), a parallel plate type, and the like, in addition to RIE.

Furthermore, as the treatment conditions during the oxygen plasma treatment, the RF output, the oxygen flow rate, the degree of vacuum, the treatment time period, the size of the treatment chamber, the electrode area, the sample temperature during the plasma treatment, adsorption moisture of the sample, and the like can be conceivable as modifiable parameters. By adjusting these parameters, an oxide film having a thickness of 5 nm or more and 25 nm or less can be formed on the outermost surface of Cu seed layer 2. Any treatment conditions can be set as long as an oxide film having a thickness of 5 nm or more and 25 nm or less can be formed on the outermost surface of Cu seed layer 2.

Figure 13:
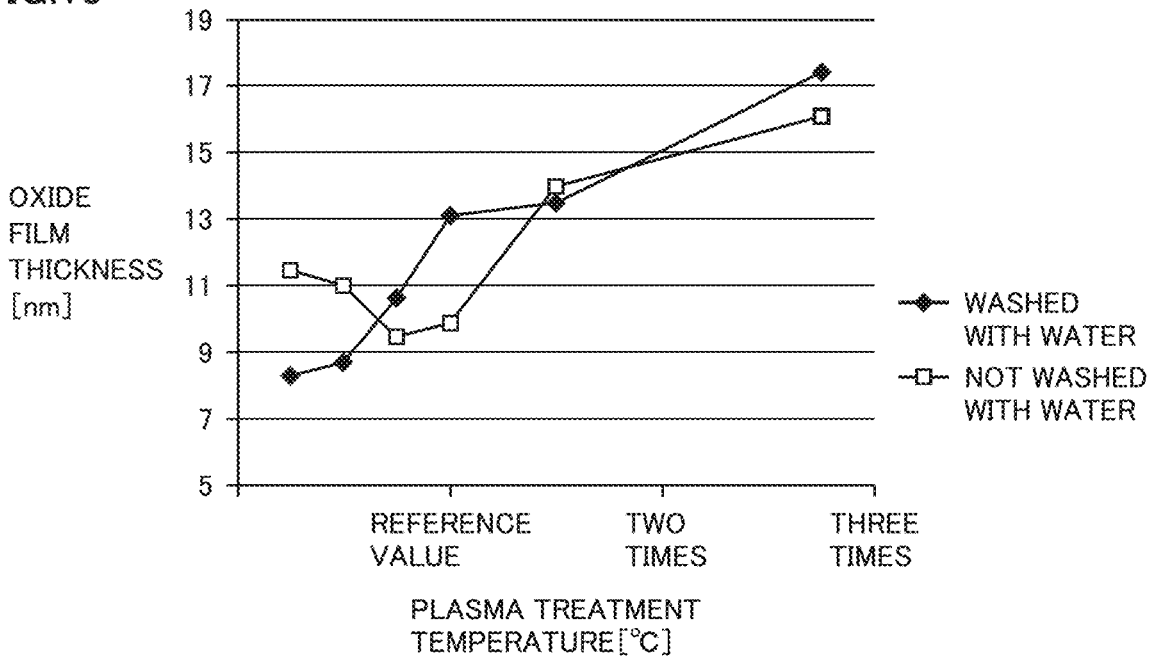
FIG. 13 is a graph showing the relation between: the thickness of the oxide film formed on the Cu seed layer; and the oxygen plasma treatment temperature and the moisture adsorbed by a sample.

FIG. 13 is a graph showing the relation between: the thickness of the oxide film formed on the Cu seed layer; and the oxygen plasma treatment temperature and the moisture adsorbed by a sample. The oxygen plasma treatment was performed in the state where the conditions other than the oxygen plasma treatment temperature (sample temperature) were fixed. The curved line showing data plotted with rhombuses (washed with water) shows the result of the sample obtained when Cu seed layer 2 adsorbed moisture before the oxygen plasma treatment. The curved line showing data plotted with square marks (not washed with water) shows the result of the sample obtained when Cu seed layer 2 did not adsorb moisture before the oxygen plasma treatment.

As shown in FIG. 13, irrespective of whether Cu seed layer 2 adsorbed moisture or not, the thicknesses of the oxide films respectively formed on the Cu seed layers varied in accordance with the substrate temperature during the oxygen plasma treatment (the plasma treatment temperature). Furthermore, even when the same oxygen plasma treatment conditions were used, the thicknesses of the oxide films respectively formed on the Cu seed layers varied depending on whether moisture was adsorbed or not. However, in the range of the treatment temperatures in which the oxygen plasma treatment is generally performed, such as the temperatures shown on the horizontal axis corresponding to the plots shown in FIG. 13, it turns out that the oxide film having a thickness of 5 nm or more and 25 nm or less that is effective in reliability improvement can be formed.

Furthermore, a resist frame is formed on the device in the actual process. Thus, it was verified whether the resist frame exerted an influence upon formation of the oxide film or not. As a result, it turned out that an oxide film is normally formed though the resist is simultaneously etched by the oxygen plasma treatment. It also turned out that the formation speed of the oxide film and the temperature dependency in oxide film formation were changed due to the existence of the resist, but such changes were not obstructive to formation of an intended oxide film of 5 nm or more and 25 nm or less. Thus, formation of an oxide film was not influenced.

Figure 14A:
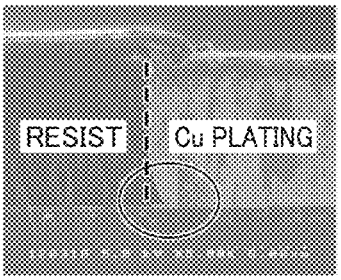
FIG. 14A is a cross-sectional SEM image of a film before resist stripping in the case where a Cu seed layer and Cu plating are formed without performing the oxygen plasma treatment.
Figure 14B:
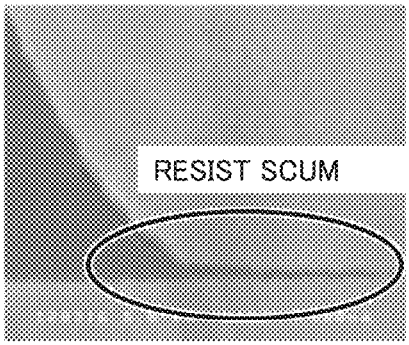
FIG. 14B is a partial enlarged view of FIG. 14A.

Furthermore, since an RIE apparatus can conduct anisotropic etching, there is also an additional effect that the resist shape can be improved by the etching effect. FIGS. 14A and 14B each show a cross-sectional SEM image of the film before resist stripping in the case where a Cu seed layer and Cu plating are formed without performing the oxygen plasma treatment. FIG. 14B is a partial enlarged view of FIG. 14A. The skirt part of the resist frame spreads in the vicinity of the substrate, and the resist digs into the plating.

Figure 14C:
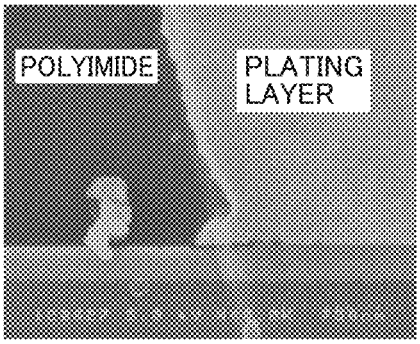
FIG. 14C is a cross-sectional SEM image of the film before resist stripping in the present embodiment.

FIG. 14C shows a cross-sectional SEM image of a film before resist stripping in the case where a Cu seed layer and Cu plating are formed by performing the oxygen plasma treatment using a method of forming Cu plating in the present embodiment. The spread of the skirt part of the resist frame is cut, so that digging into the plating is reduced for improvement. Such an improvement is required because digging into plating may deteriorate the adhesiveness of plating or may cause voids in the subsequent process. As shown in FIGS. 14A to 14C, the oxygen plasma treatment in the present embodiment can be a solution for the above-described problems, and can contribute to reliability improvement.

As described above, according to the method of forming Cu plating in the present embodiment for controlling the average grain size in the Cu seed layer and the thickness of the oxide film on the Cu seed layer for reducing the stress, it becomes possible to: suppress occurrence of voids at the interface between the Cu seed layer and the Cu plating; and improve the wettability, without adversely affecting the film characteristics of the Cu seed layer. Consequently, the reliability of the device can be improved.

It should be understood that the embodiments disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1 substrate, 2 Cu seed layer, 3 resist, 4 oxide film, 5 Cu plating.

The invention claimed is:

1. A method of forming Cu plating, the method comprising:

forming a Cu seed layer on one surface of a substrate such that an average grain size is from 50 nm to 300 nm;

forming an oxide film having a thickness of from 10 nm to 25 nm on a surface of the Cu seed layer in an oxygen atmosphere;

removing a part of the oxide film; and feeding power to the Cu seed layer to form a Cu plating on a surface of the oxide film on the Cu seed layer by electrolytic plating.

2. The method of forming Cu plating according to claim 1, wherein the oxide film formed on the surface of the Cu seed layer has a thickness of from 15 nm to 25 nm.

3. The method of forming Cu plating according to claim 1, wherein an area density of the Cu seed layer is 60% or less of an area density of the Cu plating.

4. The method of forming Cu plating according to claim 1, wherein the Cu seed layer is formed at room temperature.

5. The method of forming Cu plating according to claim 1, wherein the Cu seed layer is formed directly on the substrate.

* * * * *